United States Patent [19]

Lonati

[11] Patent Number: 4,718,254

[45] Date of Patent: Jan. 12, 1988

[54] TWIN-CYLINDER CIRCULAR KNITTING MACHINE WITH A PERFECTED DEVICE FOR ACTUATING THE TRANSFER SINKER

[75] Inventor: Francesco Lonati, Brescia, Italy

[73] Assignee: Lonati S.p.A., Brescia, Italy

[21] Appl. No.: 935,920

[22] Filed: Nov. 28, 1986

[30] Foreign Application Priority Data

Dec. 2, 1985 [IT] Italy ..... 23047 A/85

[51] Int. Cl.[4] ..... D04B 9/10

[52] U.S. Cl. ..... 66/14; 66/222

[58] Field of Search ..... 66/14, 63, 222, 223, 66/224, 226

[56] References Cited

U.S. PATENT DOCUMENTS 2,755,645 7/1956 Deans et al. ..... 66/14

2,995,910 8/1961 Levin ..... 66/224

FOREIGN PATENT DOCUMENTS 144656 8/1984 Japan ..... 66/14

*Primary Examiner*—William Carter Reynolds

*Attorney, Agent, or Firm*—Guido Modiano; Albert Josif

[57] ABSTRACT

The machine comprises a plurality of selectors which are slideably accommodated in the grooves of the lower needle-bearing cylinder and act each with its upper end on a transfer sinker, or slider, for moving the matching needle. The machine has the peculiarity that in a same groove of the lower needle-bearing cylinder is accommodated, proximate to the upper end of the selector, a pusher element, controllably engageable with the lower end of the matching transfer sinker. The pusher element has the possibility of being operated independently from the selector accommodted in the same groove, since it is provided with a heel which is engageable in suitably defined tracks on the skirt of the cams of the lower needle-bearing cylinder.

10 Claims, 4 Drawing Figures

TWIN-CYLINDER CIRCULAR KNITTING MACHINE WITH A PERFECTED DEVICE FOR ACTUATING THE TRANSFER SINKER

BACKGROUND OF THE INVENTION

The present invention relates to a twin-cylinder circular knitting machine with a perfected device for actuating the transfer sinkers.

As is known, in twin-cylinder knitting machines it is necessary to operate in a different manner the transfer sinkers, or sliders, situated in the grooves of the lower needle-bearing cylinder which have transferred the corresponding needles into the upper needle-bearing cylinder, i.e. purl, with respect to the transfer sinkers which instead control the needles which operate in the lower cylinder, i.e. in plain knit.

During processing, in fact, the need arises to carry the point of the transfer sinkers, the needle of which is in the upper cylinder, to open the tab of the matching needle before the same reaches the feed from which it is to capture the thread, while the other transfer sinkers, which operate the plain-knit needles, must be operated so as to make the corresponding needle form knitting or to exclude the same from the forming of the knitting.

In order to achieve this diversified actuation, in the skirt of the cams of the lower cylinder two separate tracks are provided, with which engage respectively the heels of the transfer sinkers with plain-knit needles, or the heels of the transfer sinkers with purl needles; generally, the track with which the heels of the sinkers with purl needles engage, which can be eventually replaced by a track with which engage the heels of the selectors which act on these sinkers, is termed "memory".

The need to have two tracks in the skirt of the cams of the lower needle-bearing cylinder gives rise to some disadvantages, particularly in the case when it is desired to increase the rotation speed of the machine.

Indeed, due to the presence of a double path of the heels of the transfer sinkers, the slopes of the ascending and descending portions of the tracks, in which the heels of the transfer sinkers engage, have rather significant inclinations such as to prevent a satisfactory performance of the machine at high speeds without entailing rapid and damage of the sinkers.

SUMMARY OF THE INVENTION

The aim proposed by the invention is to eliminate the above described disadvantage by providing a twin-cylinder knitting machine with a perfected device for actuating the transfer sinkers, so as to allow a reduction of the space required in the skirt of the cams by the tracks which move the transfer sinkers to allow to achieve, for these tracks, less sharply sloping ascending and descending portions, or to achieve, with the machine according to the invention, higher operating speeds with respect to the speeds hitherto attained with the machines of the prior art.

Within the scope of the above described aim, an object of the invention is to be able to employ sections of a same track both for operating the transfer sinkers without needles, since they operate purl, and for operating the transfer sinkers which control the plain-knit needles, again to achieve a reduction in required space.

This aim, as well as this and other objects, which will become apparent hereinafter, are achieved by a circular knitting machine with a perfected device for actuating the transfer sinkers, comprising a plurality of selectors slideably accommodated in the grooves of the lower needle-bearing cylinder and each acts with its upper end on a transfer sinker for moving the corresponding needle, characterized in that in a same groove of the lower needle-bearing cylinder is accommodated, proximate to the upper end of the selector, a pusher element controllability engageable with the lower end of the corresponding transfer sinker, control means being provided for operating said pusher element independently from said selector.

BRIEF DESCRIPTION OF THE DRAWINGS

Further characteristics and advantages of the invention will become apparent from the detailed description of a preferred, but not exclusive embodiment of the machine according to the invention, illustrated by way of non-limitative example in the accompanying drawings, where.

DESCRIPTION OF THE PREFERRED EMBODIMENTS

Figure 1:
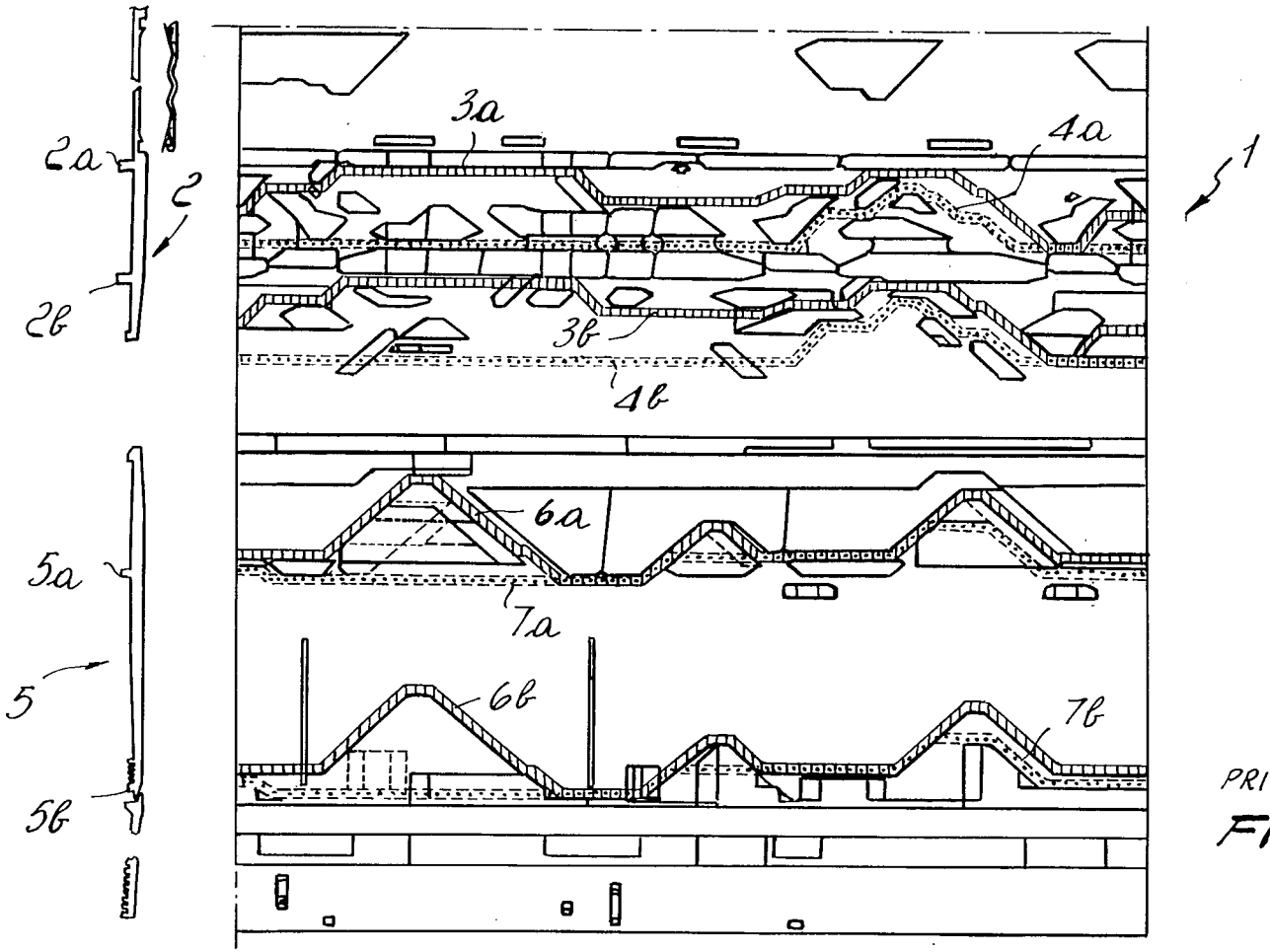
PRIOR ART Fig. 1
FIG. 1 is a front elevation view of the skirt of the cams of the lower cylinder, developed on a plane, of a twin-cylinder circular machine of a known kind provided laterally with a selector, a needle and a transfer sinker; rotated through 90 degrees for clarification purposes.

FIG. 1 illustrates the plane extension of the skirt of the cams of the lower needle-bearing cylinder, generally indicated by the reference numeral 1, of a twin-cylinder circular machine for stockings of a known kind.

As can be seen in the upper part of the drawing, related to the cams which engage with the heels 2*a* and 2*b* of the transfer sinkers or sliders 2, there is a diversification between the tracks 3*a* and 3*b*, indicated by a solid line, followed by the heels of the transfer sinkers the needles of which operate in the upper needle-bearing cylinder, i.e. purl, and the tracks 4*a* and 4*b*, indicated with a dotted line, followed by the heels of the transfer sinkers which are coupled to the needles which are instead operating in the lower needle-bearing cylinder, i.e. in plain-knit. The tracks followed by the heels 5*a* and 5*b* of the selectors 5 which act on the transfer sinkers are indicated similarly; the tracks 6*a* and 6*b*, indicated with a solid line, are followed by the heels of the selectors which have carried the purl needle, while the tracks 7*a* and 7*b*, indicated with a dotted line, are followed by the heels of those selectors the corresponding needle of which is accommodated in the lower needle-bearing cylinder.

As can be seen, the tracks 3*a* and 4*a*, as well as the tracks 3*b* and 4*b*, have separate paths, and this fact, as has been described, entails steep inclination of the ascending and descending portions of said tracks.

Figure 2:
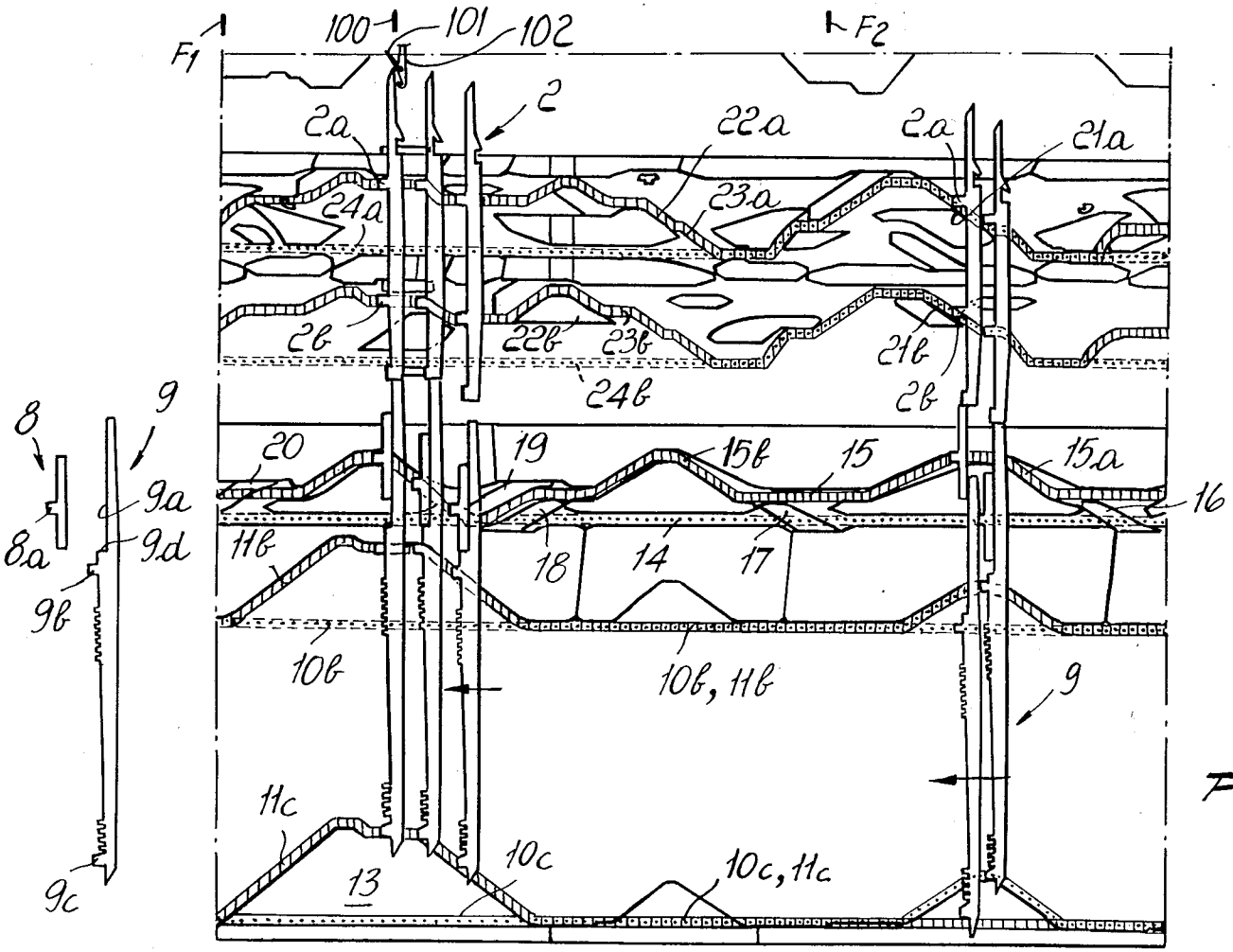
FIG. 2 is a front elevation view of the skirt of the cams of the lower cylinder, developed on a plane, of a twin-cylinder circular machine according to the invention, illustrating a few selectors, transfer sinkers and pusher elements rotated through 90 degrees for better clarity.
Figure 4:
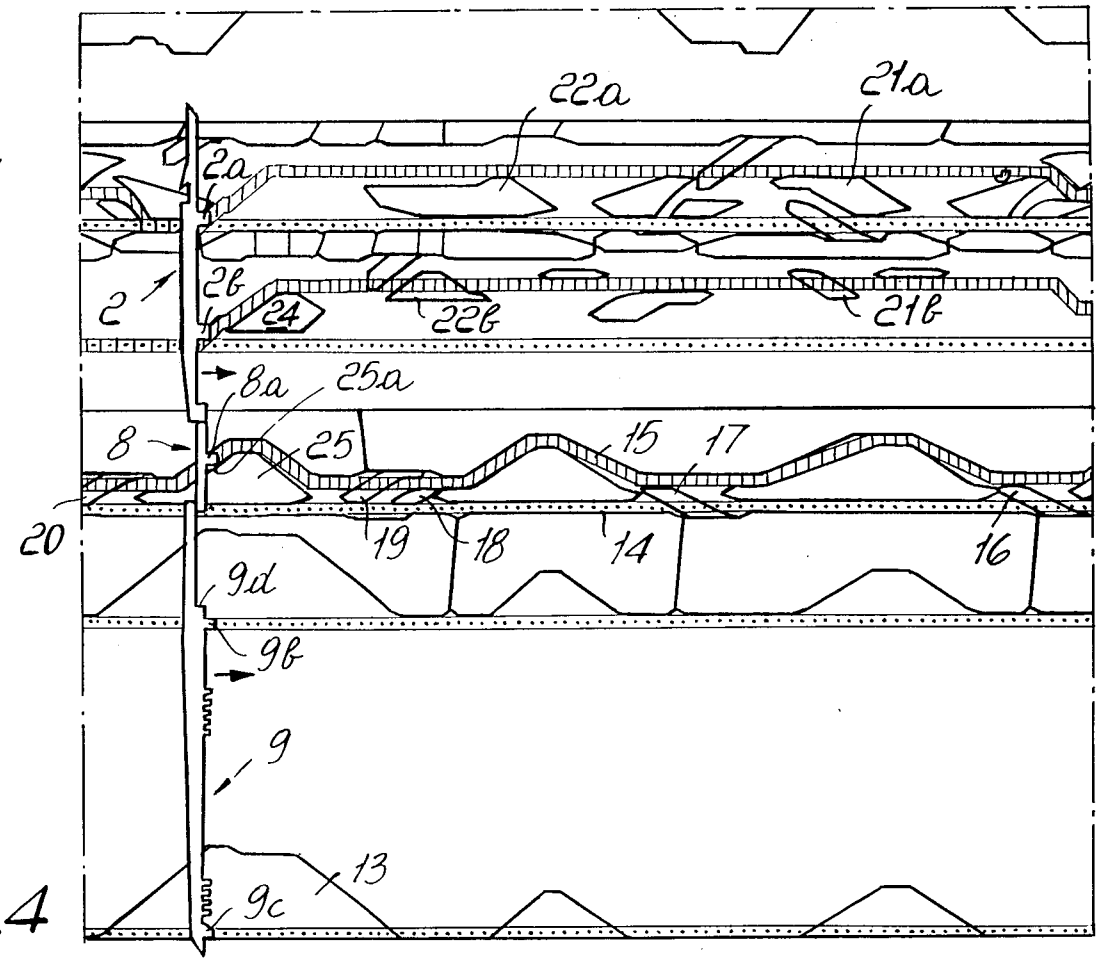
FIG. 4 is a view, similar to that of FIG. 2, of the skirt of the cams of a machine according to the invention, indicating the path of the heel of the selectors, of the pusher elements and of the transfer sinkers during the return phase of the alternate motion for forming the toe and the heel of a stocking.
Figure 3:
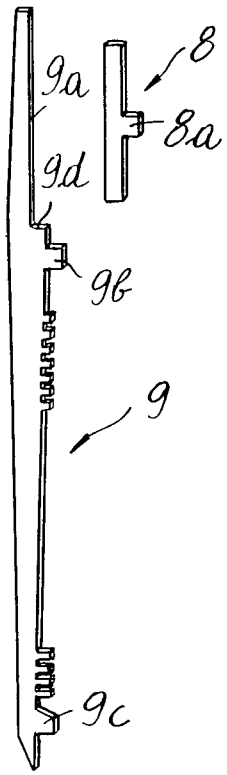
FIG. 3 is a perspective view of a selector with the pusher element according to the invention.

As is illustrated in FIGS. 2 and 4, the sloping of these ascending and descending portions can be significantly reduced in a machine according to the invention wherein there is no need to rigidly separate the tracks followed by the heels 2*a* and 2*b* of the transfer sinkers, the needles of which operate in purl from those traced by the sinkers, the needles of which operate in plain-knit.

This fact is achieved by providing pusher elements 8, composed of rods with a flattened cross section, having a thickness which is substantially equal to that of the selectors, accommodated therewith in the grooves of the lower needle-bearing cylinder.

Each pusher element 8 is provided, in an intermediate portion thereof, with a heel 8*a* which extends similarly to the heels of the transfer sinkers 2 and is partially accommodated in a recess 9*a* defined proximate to the upper end of a selector 9 on the side of the selector which carries the heel 9*b*, so that the heel 8*a* of the pusher element 8 is directed in the same direction as the heel 9*b* of the selector.

The selector 9, similarly to selectors of the prior art, is furthermore provided, besides the heel 9*b*, with another heel 9*c* at its lower end, and the two heels have the possibility of engaging, according to the requirements of the processing, tracks defined in the skirt of the cams of the lower cylinder. In the drawings, for the sake of clarity, two possible tracks for each heel have been illustrated, wherein the tracks 10*b* and 10*c*, indicated with a dotted line, are followed by the heels 9*b* and 9*c* when the needle corresponding to the selector being considered is in the lower cylinder, while the tracks 11*b* and 11*c*, indicated with a solid line, are followed by the heels 9*b* and 9*c* when the needle matching the selector being considered is in the upper cylinder.

According to the invention, control means are provided for operating the pusher element 8 independently from the selector which carries it; in the skirt of the cams of the lower needle-bearing cylinder, in fact, a second plurality of cams is provided, above the first plurality of cams which control the selectors, which are engageable with the heel of the pusher elements.

This second plurality of cams defines at least one idle track 14, shown in dotted lines, and an active track 15, shown in solid lines, wherein the heels 8*a* can engage. For passing from track 14 to track 15, the cams 16, 17 and 18 have been provided, while for the return to the track 14 the canceling cams 19 and 20 have been provided; these cams are controllably extractable from or placeable in the skirt of the cams.

Furthermore, the passage from the track 14 to the track 15 is achieved by raising the selectors which achieve the transfer of the corresponding needle from the lower cylinder to the upper cylinder, since during this raising the shoulder 9*d* defined by the lower end of the recess 9*a* acts on the lower end of the pusher element, thus effecting the passage.

The pusher elements, which advantageously have a length which is smaller than the height of the recess 9*a* of the selectors, when their heel 8*a* is in the active track 15, are in contact with the lower end of the transfer sinkers 2 and can act thereon alternately with the selectors, while, when their heels are on the idle track, the selectors can act on the transfer sinkers.

By providing in the track 15 an ascending portion 15*a* and 15*b* upstream of every feed at which the purl needles must capture the thread, it is possible to raise the transfer sinkers corresponding to these needles at such a level that their upper heel 2*a* engages with a raising cam 21*a*, 22*a* which takes said sinkers to engage with their lower heel 2*b* with another raising cam 21*b*, 22*b* which achieves a further raising of the sinkers, which can thus open the latches 101 of the purl needles 102.

In this manner, as can be seen in FIG. 2 in which the tracks 23*a* and 23*b* traversed by the heels of the sinkers with purl needles are indicated by solid lines, and the tracks 24*a* and 24*b* traversed by the heels of the sinkers with plain-knit needles are indicated with dotted lines there is the possibility of superimposing the tracks, through diversifying the actuation of the plain-knit needle sinkers from the actuation of the purl-needle sinkers since the "memory" of the purl needles is kept by the pusher elements 8, and the actuations related to these needles are provided by the track 15.

To better clarify the operation of the machine with the device according to the invention, two operating phases are described, respectively related to the forming of the leg of the stocking and to the forming of the point or of the heel.

Upon the transfer of the needles (occuring at the location indicated by the reference numeral 100 in FIG. 2) which must operate in purl in the upper cylinder, which is achieved by the engagement of the heel 9*c* of the selectors with the cam 13, the pusher elements 8 of these selectors are raised by the same selectors and their heels 8*a* pass from the tracks 14 to the track 15 and stay in this track until the canceling cam 19 or 20 is operated. Once the transfer is completed, the heels of the selectors return to the track 10*c*.

The figures illustrate a twin-feed machine, and the case is shown in which only the purl needles are to capture the thread from the first feed F1, while both the purl and the plain needles are to capture the thread from the second feed F2 (FIG. 2).

Ahead of these feeds are respectively placed the raising cams 22*a* and 22*b* and the raising cams 21*a* and 21*b*. Upstream of the first feed, the pusher element 8 placed under the purl-needle sinkers rising along the section 15*b* of the track 15 are raised and carry the heels 2*a* of the matching sinkers to engage with the cam 22*a*, and by virtue of this cam, the heels 2*b* engage with the cam 22*b* which raises the sinkers to open the latches 101 of the purl needles 102, while the sinkers with plain-knit needles are not raised.

Upstream of the second feed, the pusher elements 8 placed under the sinkers with a purl needle rise along the section 15*a* and carry the heels 2*a* of the corresponding sinkers to engage with the cam 21*a*, and by virtue of this cam, with the cam 21*b*. The sinkers with plain-knit needle are also raised, but by means of the related selector, and rise on the cams 21*a* and 21*b*. With the same section of track, both the opening of the latches of the purl needles and the rising for capturing the thread on the part of the plain-knit needles are achieved, as is illustrated in FIG. 2, wherein the rightmost sinker carries a plain-knit needle and the second rightmost sinker carries a purl needle.

In the forming of the heel and of the toe of the stocking, the needles of half the cylinder are accommodated in the lower cylinder and for some kinds of actuation of the sinkers it is possible to use the pusher elements 8 which are carried into the track 15 by the cams 16 or 17.

Thus, as an example, in the return motion of the cylinders it is possible to carry the heel 2*b* of the sinkers with active needles on a cam 24, which causes the unloading of the knitting on the needles when the matching pusher elements engage with the section 25*a* of the cam 25 arranged downstream of the first feed, as illustrated in FIG. 4, wherein the tracks followed by the heels of the sinkers with needles which are to capture the thread at the first feed have been shown in vertical dash lines, and the tracks of the heels of the sinkers with needles left out of the capture of the thread at this feed are shown in dotted lines.

In practice, it has been observed that the machine with the actuating device for the transfer sinkers according to the invention fully achieves the intended aim, since, by virtue of the fact that the pusher elements with the heels in the active track act as a "memory" of the needles which have been transferred into the upper cylinder, it is possible to have in the skirt of the cams of the lower cylinder, tracks with sections which can be traversed, both by the heels of the sinkers with plain needle and by the heels of the purl needle sinkers, with a consequent reduction in height of the required dimensions, which leads to reduced slopes of the ascending and descending sections with respect to what occurs in the machines of the prior art.

A further advantage is that it is possible to employ the pusher elements and the tracks provided for the same to achieve, as well as the opening of the latches of the purl needles, also other actuations currently provided with the selectors.

Not least advantage is that of having reduced the use and therefore the wear of the selectors which are more complicated and expensive to provide with respect to the described pusher elements.

The machine with the sinker operating device thus conceived is susceptible of several modifications and variations, all of which are within the scope of the inventive concept; thus, as an example, besides the cams described others might be provided for different or particular processing. Furthermore, all the details can be replaced by technically equivalent elements.

In practice, the materials employed, as well as the dimensions, may be any according to the requirements and to the state of the art.

I claim:

1. Twin-cylinder circular knitting machine with a perfected device for actuating the transfer sinkers, comprising a plurality of selectors which are slideably accommodated in the grooves of the lower needle-bearing cylinder and each act each with its upper end on a transfer sinker for moving the corresponding needle, characterized in that in a same groove of the lower needle-bearing cylinder is accommodated, proximate to the upper end of the selector, a pusher element controllably engageable with the lower end of the corresponding transfer sinker, control means being provided for operating said pusher element independently from the selector.

2. Machine according to claim 1, wherein said pusher element is substantially composed of a rod with a flattened cross section, with a heel protruding on the same side as the heel of the matching selector, said rod being accommodatable in a recess open upwardly and defined in an upper section of the selector on the side bearing the heel.

3. Machine according to claim 2, wherein said pusher element is downwardly engageable with the lower end of said recess and upwardly engageable with the lower end of the corresponding transfer sinker.

4. Machine according to claim 2, wherein said pusher element has a length which is smaller than the height of said recess.

5. Machine according to claim 1, wherein said control means comprise a second plurality of cams carried by the skirt of the cams of the lower cylinder above a first plurality of cams engageable with the heels of the selectors, said second plurality of cams defining tracks engageable with the heels of the pusher elements.

6. Machine according to claim 1, wherein said control means comprise a second plurality of cams carried by the skirt of the cams of the lower cylinder above a first plurality of cams engageable with the heels of the selectors, said second plurality of cams defining tracks engageable with the heels of the pusher elements, and wherein said tracks defined by said second plurality of cams comprise at least one idle track for preventing interference of the pusher elements having the heels engaged therein with the corresponding transfer sinkers and an active track with ascending portions for carrying the pushers to interfere with the corresponding transfer sinkers, controllable means being provided for passing the heels of said elements from said idle track to said active track and vice versa.

7. Machine according to claim 6, wherein said controllably activatable means for passing the heels of said pusher elements from said idle track to said active track are substantially composed of said selectors.

8. Machine according to claim 6, wherein said controllably activatable means for passing the heels of said pusher elements from said idle track to said active track or vice versa are substantially composed of cams which are controllably extractable from the skirt of the cams of the lower needle-bearing cylinder for interfering with the heels of said pusher elements.

9. Machine according to claim 6, wherein said selectors engage with the corresponding pusher element to carry it from said idle track to said active track upon the transfer of the corresponding needle from the lower needle-bearing cylinder to the upper needle-bearing cylinder.

10. Machine according to claim 6, wherein said active track has an ascending section at least upstream of one feed for carrying the pusher elements, accommodated in the grooves of the lower needle-bearing cylinder, having the needle active in the upper needle-bearing cylinder, to raise the matching transfer sinker for opening the latch of said active needle in the upper needle-bearing cylinder.

* * * * *